US008406446B2

(12) United States Patent
Akino

(10) Patent No.: US 8,406,446 B2
(45) Date of Patent: Mar. 26, 2013

(54) MICROPHONE WITH VIBRATION ISOLATION

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 116 days.

(21) Appl. No.: 13/045,940

(22) Filed: Mar. 11, 2011

(65) Prior Publication Data

US 2011/0235842 A1 Sep. 29, 2011

(30) Foreign Application Priority Data

Mar. 25, 2010 (JP) ..... 2010-069430

(51) Int. Cl.
*H04R 1/02* (2006.01)

(52) U.S. Cl. ..... 381/360; 381/361; 381/368; 381/363; 381/362; 381/354

(58) Field of Classification Search ..... 381/353, 381/360, 368, 362, 361, 363
See application file for complete search history.

(56) References Cited

U.S. PATENT DOCUMENTS

| | | | | |
|---|---|---|---|---|
| 3,585,317 | A * | 6/1971 | Dvorsky | 381/368 |
| 4,457,120 | A * | 7/1984 | Takata | 52/309.4 |
| 6,128,393 | A * | 10/2000 | Kondo | 381/368 |
| 2005/0226450 | A1 * | 10/2005 | Akino | 381/361 |
| 2006/0088169 | A1 * | 4/2006 | Akino | 381/26 |
| 2010/0092021 | A1 * | 4/2010 | Wiskerke et al. | 381/364 |
| 2011/0026752 | A1 * | 2/2011 | Yao et al. | 381/355 |

FOREIGN PATENT DOCUMENTS

JP 2005-277652 10/2005

* cited by examiner

*Primary Examiner* — Curtis Kuntz
*Assistant Examiner* — Thomas Maung
(74) *Attorney, Agent, or Firm* — Whitham Curtis Christofferson & Cook, PC

(57) ABSTRACT

A microphone includes: a housing that serves as a microphone grip; a microphone unit supported at one end of the housing; an air chamber provided behind the microphone unit in the housing. The air chamber is filled with a plurality of elastic particles. The individual particles are mechanically bonded to one another and part of the particles are mechanically bonded to the housing such that gaps are formed therebetween.

3 Claims, 3 Drawing Sheets

MICROPHONE WITH VIBRATION ISOLATION

BACKGROUND OF THE INVENTION

1. Field of the Invention

The present invention relates to a microphone, and in particular to vibration isolation inside a housing that serves as a microphone grip and supports a microphone unit of the microphone.

2. Description of the Related Art

Japanese Patent Application Publication No. 2005-277652 discloses that an air chamber is one element that determines frequency characteristics of a microphone. The air chamber is provided at a rear part of a microphone unit to improve the frequency characteristics over a wide range. For the purpose of achieving excellent frequency characteristics even in low frequency bands, the reactance in the air chamber must be reduced by increasing the volume of the air chamber. In general, a handheld microphone such as a vocal microphone has an air chamber inside a cylindrical housing that serves as a microphone grip. A typical example is described below with reference to FIGS. 2 and 3.

A handheld dynamic microphone 15 includes a cylindrical housing 2 formed by die casting. The microphone unit 3 is supported at one end of the housing 2. Although not shown in the drawings, the microphone unit 3 includes therein a diaphragm to which a voice coil is fixed and a magnetic circuit having a magnetic gap. The voice coil fixed to the diaphragm is vibratably disposed in the magnetic gap. The rear end of the microphone unit 3 is airtightly fit to a connection portion 12 to be attached to one end of the housing 2 with the connection portion 12.

A connector attachment portion 2*b* is integrally formed at the other end of the housing 2. A connector 4 is mounted in the connector attachment portion 2*b*. The microphone unit 3 is connected with the connector 4 thorough a lead wire 8. A cavity inside the housing 2 serves as an air chamber 10 at the rear side of the microphone unit 3.

It is preferable to increase the volume of the air chamber 10 for improving sound quality even in low frequency bands. In order to achieve excellent frequency characteristics, intrusion of external air into the air chamber 10 must be prevented. In the dynamic microphone 15, after the microphone unit 3 is connected with the connector 4 through the lead wire 8, a gap between the housing 2 and the connector 4 is sealed with a sealing material 6 such as silicon sealant. Accordingly, the air chamber 10 has an airtight structure.

The housing 2 is generally composed of metal, resin or any other material. Since a gap is formed between the housing 2 and the other components included in the dynamic microphone 15, the housing 2 resonates in response to vibration or impact thereto and generates dissonant noise. In particular, a handheld microphone a user uses by holding the housing (grip) 2 with his/her hand(s) has a significant disadvantage of generation of such vibration. Conventional countermeasures described below have been taken against such a disadvantage on vibration. For resolving the vibration problem, a dumping material such as a rubber 5 is attached to the inner peripheral surface of the housing 2 as shown in FIG. 2 or a sponge 14 is crammed into the housing 2 as shown in FIG. 3. However, these countermeasures are not effective enough to absorb vibration and to prevent noise of the dynamic microphone 15. Another disadvantage is low frequency characteristics of the dynamic microphone 15 if the air chamber 10 of the housing 2 is filled with the sponge 14 as shown in FIG. 3.

SUMMARY OF THE INVENTION

An object of the present invention is to provide a microphone that includes an air chamber filled with a sponge, does not generate dissonant noise caused by vibration or impact on the housing, and thus can maintain excellent frequency characteristic.

According to an aspect of the present invention, a microphone includes: a housing that serves as a microphone grip; a microphone unit supported at one end of the housing; and an air chamber behind the microphone unit in the housing, the air chamber being filled with a plurality of elastic particles, in which the individual particles are mechanically bonded to one another and part of the particles are mechanically bonded to the housing such that gaps are formed therebetween.

DETAILED DESCRIPTION OF THE PREFERRED EMBODIMENTS

Figure 2:
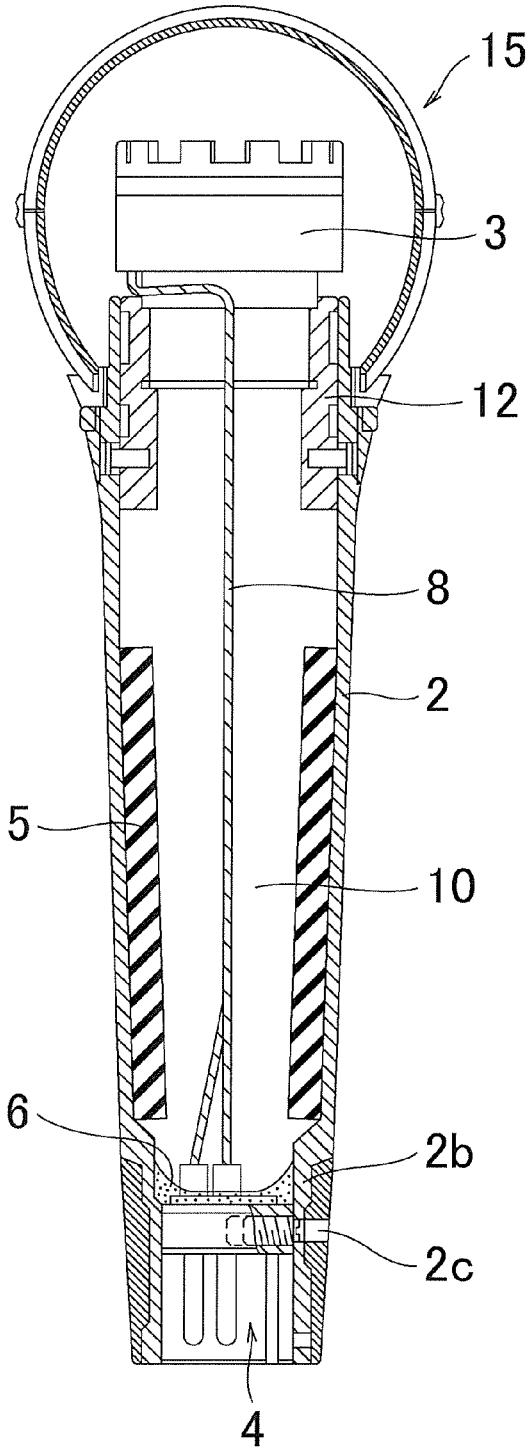
RELATED ART FIG. 2
FIG. 2 is a longitudinal cross-sectional view of a typical conventional microphone.
Figure 3:
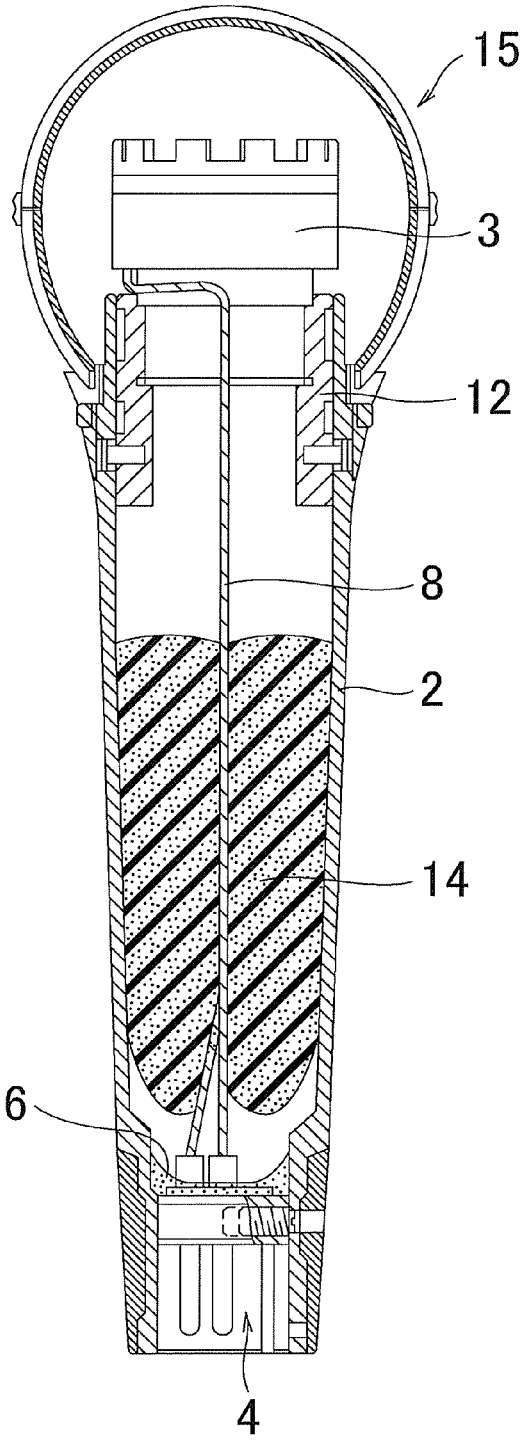
RELATED ART FIG. 3
FIG. 3 is a longitudinal cross-sectional view of another conventional microphone.

A microphone according to an embodiment of the present invention will be described below with reference to the accompanying drawings. The microphone according to the present invention should not be limited to the structure of the embodiment described below. Elements similar to those in the conventional microphones shown in FIGS. 2 and 3 are given the same reference numerals.

Figure 1:
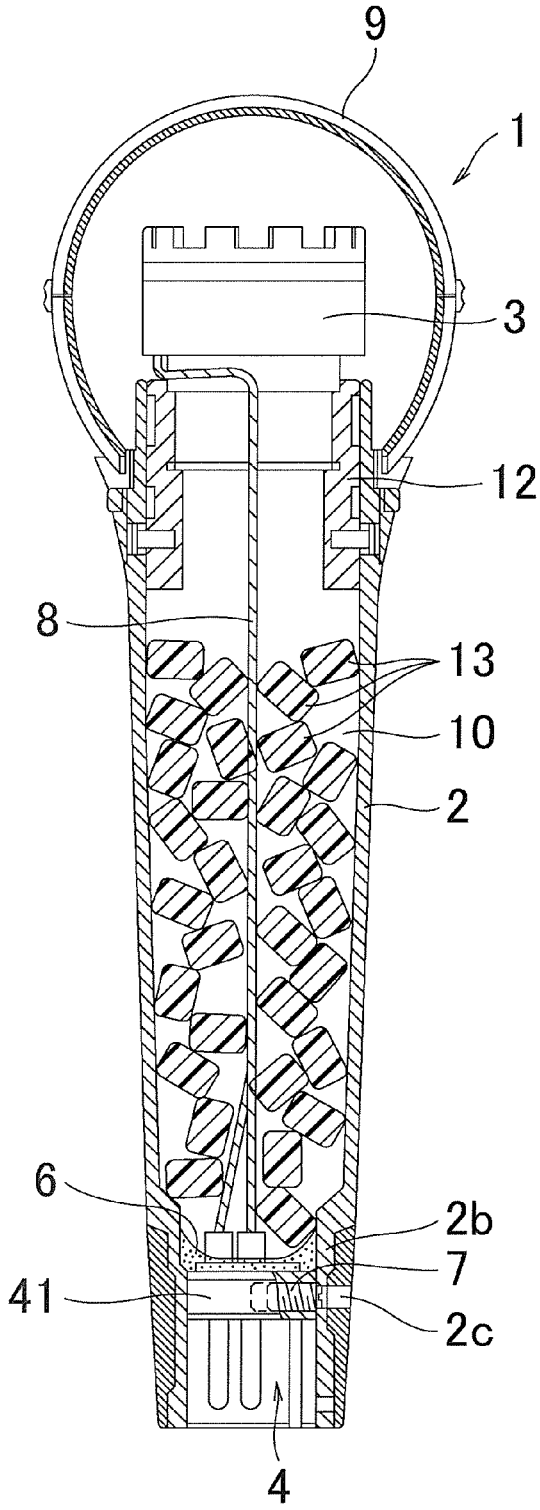
FIG. 1 is a longitudinal cross-sectional view of an exemplary microphone according to an embodiment of the present invention.

As shown in FIG. 1, a microphone 1 includes a cylindrical housing 2 serving as a microphone grip, a microphone unit 3, and a connector 4. The rear surface of the microphone unit 3 is supported at one end of the housing 2 (the upper end of the housing 2 in FIG. 1). The connector 4 is provided at the other end of the housing 2, and is electrically connected to the microphone unit 3. Note that the connector 4 is not an essential component for the present invention and any device that connects the microphone 1 with the exterior thereof can be used.

After connection of the microphone unit 3 with the connector 4 through the lead wire 8, a gap between the housing 2 and the connector 4 is filled with a sealing material 6, for example a silicon sealant. Accordingly, the other end, adjacent the connector 4, of the housing 2 is sealed with the seal material 6 to form an air chamber 10 providing an airtight structure. The interior of the sealed cavity functions as the air chamber 10 that is included in a part of an acoustic circuit of the microphone unit 3.

The air chamber 10 is filled with a plurality of particles 13 composed of a polymer damping material. The individual particles 13 are mechanically bonded to one another by being fused at the surfaces thereof and part of these particles 13 are further mechanically bonded to the housing 2 such that gaps are formed between these particles 13 and between each particle 13 and the housing 2. Each of the particles 13 has a pellet shape. The gaps are formed between the particles 13 when the cylindrical air chamber 10 is filled with the particles 13 as shown in FIG. 1. The particles 13 may be composed of any material. For example, "Neofade (registered trademark)" by MITSUBISHI GAS CHEMICAL COMPANY, INC. which includes organic materials and inorganic materials such as metals, may be used as pellets. Such an elastic damping material can more effectively prevent the vibration of the housing 2. Alternatively, the particles 13 may be composed of an insulating organic material. Accordingly, the microphone 1 according to the embodiment of the present invention, which includes the particles 13 in the portion including the circuit, can suppress the vibration without electric leakage. Common organic materials such as polyethylene and polypropylene may be used for damping materials of the particles 13.

As described above, the air chamber 10 of the housing 2 is filled with the elastic particles 13. Furthermore, these particles 13 are mechanically bonded to one another and part of these particles 13 are further mechanically bonded to the housing 2 such that gaps are formed therebetween. This structure does not generate dissonant noise caused by vibration or impact on the housing 2. Since the gaps are formed between the particles 13 and between each particle 13 and the housing 2, the microphone unit of the microphone 1 has excellent frequency characteristics without vibration.

The microphone unit 3 has a cylindrical shape and has a crown at the front end thereof. The rear end of the microphone unit 3 is airtightly fit to the connection portion 12 to be attached to one end of the housing 2, by any appropriate means, for example, by cramming, screwing, or bonding. The end, adjacent the microphone 3, of housing 2 is protected by a spherical head casing 9 having a hollow interior and an opening at the bottom. The head casing 9 is attached to the housing 2 by any appropriate means. The diameter of the housing 2 gradually decreases toward the connector 4.

The connector 4 may be any known connector. For example, the connector 4 may be a three-pin connector specified in EIAJ RC-5236 "Latch Lock Type Round Connector for Audio Equipment", which has a first pin for grounding, a second pin for the hot side of signals, and a third pin for the cold side of the signals embedded in a cylindrical connector base 41 composed of an electrically insulating material.

A male thread 7 is provided on the side surface of the connector base 41 while a connector attachment portion 2*b* has a hole 2*c* into which the male thread 7 is screwed. The male thread 7 is loosened so that the shoulder of the male thread 7 presses the inner peripheral surface of the housing 2. At the opposite side of the pressed portion between the shoulder of the male thread 7 and the inner peripheral surface of the housing 2, the connector base 41 is pressed by the inner peripheral surface of the housing 2. Thus, the connector 4 is fixed to the connector attachment portion 2*b*. The male thread 7 is loosened to be drawn from the connector base 41 with a screw driver (not shown) that is inserted into the hole 2*c*, so that the shoulder of the male thread 7 comes into contact with the inner peripheral surface of the connector attachment portion 2*b*. As a result, the housing 2 is electrically connected to a ground terminal strip (not shown). In addition to the structure described above, any other appropriate structure may also be used for fixation of the connector 4. Since the microphone unit 3 according to the embodiment of the present invention is a dynamic (electrodynamic) microphone unit, it includes a diaphragm to which a voice coil is fixed and a magnetic circuit having a magnetic gap. The voice coil fixed to the diaphragm is vibratably disposed in the magnetic gap.

The connector 4 is installed in the housing 2 by being inserted into the connector attachment portion 2*b*. Further, the shoulder of male thread 7 is pressed to the inner peripheral surface of the housing 2 by unwinding the male thread 7 so that the connector 4 is fixed to the connector attachment portion 2*b*. Moreover, the gap between the inside surface of the connector base 41 and the inner peripheral surface of the housing 2 is sealed with the seal material 6.

A method for manufacturing the microphone 1 according to an embodiment of the present invention will be described with reference to the drawings. The method is characterized in that the individual particles 13 are mechanically bonded to one another and part of the particles 13 are mechanically bonded to the housing 2 such that the gaps are provided therebetween. Any other method for manufacturing the microphone may be applied under an appropriate design concept.

The method for manufacturing the microphone 1 according to an embodiment of the present invention includes the steps of: filling the housing 2 with the plurality of particles 13, mechanically bonding surfaces of the particles 13 and the surfaces of part of the particles 13 with the housing 2 by feeding a solvent (not shown) into the housing 2, and then removing the solvent.

In the step of filling the housing 2 with the particles 13, the microphone unit 3 is connected to the connector 4 with the lead wire 8, the particles 13 are then fed into the air chamber 10 of the housing 2. The amount of the particles 13 should be determined such that no particle 13 is spilled out of the air chamber 10.

In the next step, a solvent (not shown) is fed into the housing 2 to dissolve the surfaces of the organic particles 13, and then bond the individual particles 13 with one another and part of the particles 13 with the inner periphery of the housing 2. An organic solvent such as toluene or xylene may be used for the solvent. In view of recent environmental and human health issues, any other alternative solvent may be used.

In the next step, the solvent is removed by an appropriate process such as a drying process in a drying chamber. In a final assembly step of the microphone, the microphone unit 3 is covered to be protected by a head casing 9 composed of, for example, a mesh metal. The particles 13 may be composed of a damping polymer material or an insulating material.

The embodiments of the present invention have been explained above. However, the present invention should not be limited to the embodiments. Other modifications may be made without departing from the scope of invention as defined in the claims. For example, the features of the microphone 1 according to the embodiment of the present invention may be used for vibration isolation not only in dynamic microphones but also in, so called, capacitor microphones.

In the microphone according to the embodiments of the present invention, the individual particles are mechanically bonded to one another and part of the particles are mechanically bonded to the housing such that gaps are formed therebetween. Since the gaps are formed between the particles and between each particle and the housing 2, the microphone unit of the microphone has excellent frequency characteristics due to the air chamber filled with the particles for preventing the vibration.

What is claimed is:

1. A microphone with a combination of particles and air gaps in a chamber to reduce vibration and have improved frequency characteristic, comprising:

a housing that serves as a microphone grip, a microphone unit supported at one end of the housing, and an air chamber behind the microphone unit in the housing, wherein a majority of the air chamber is filled with a plurality of elastic particles, wherein the individual particles are mechanically bonded to one another and part of the particles are mechanically bonded to the housing such that gaps are formed therebetween.

2. The microphone according to claim 1, wherein the plurality of particles comprise a damping material.

3. The microphone according to claim 1, wherein the plurality of particles comprise an insulating material.

* * * * *